US005556309A

United States Patent [19]

Sharpe et al.

[11] Patent Number: 5,556,309

[45] Date of Patent: Sep. 17, 1996

[54] BATTERY TERMINAL CONNECTOR

[75] Inventors: Barry L. Sharpe; Eian D. Mathieson, both of Sydney, Australia

[73] Assignee: Matson Automotive Industries Pty Ltd, Greenacre, Australia

[21] Appl. No.: 335,768

[22] PCT Filed: May 12, 1993

[86] PCT No.: PCT/AU93/00218

§ 371 Date: Nov. 8, 1994

§ 102(e) Date: Nov. 8, 1994

[87] PCT Pub. No.: WO93/23894

PCT Pub. Date: Nov. 25, 1993

[30] Foreign Application Priority Data

May 12, 1992 [AU] Australia ..... PL2382

[51] Int. Cl.$^6$ ..... H01R 4/48; H01R 11/22

[52] U.S. Cl. ..... 439/759; 439/761; 439/757; 439/756; 439/772; 439/773; 439/799

[58] Field of Search ..... 439/759, 761, 439/756, 757, 772, 773, 100, 799

[56] References Cited

U.S. PATENT DOCUMENTS

| | | | |
|---|---|---|---|
| 1,930,772 | 10/1933 | Richter et al. | 439/759 |
| 1,943,190 | 1/1934 | Sands | 439/772 |
| 4,385,796 | 5/1983 | Eriksson | 439/772 |
| 5,087,214 | 2/1992 | Dewar | 439/761 |

FOREIGN PATENT DOCUMENTS

| | | | |
|---|---|---|---|
| 2440093 | 10/1978 | France . | |
| 0131925 | 6/1951 | Sweden | 439/799 |

*Primary Examiner*—P. Austin Bradley
*Assistant Examiner*—T. C. Patel
*Attorney, Agent, or Firm*—Darby & Darby, P.C.

[57] ABSTRACT

A snap-lock battery terminal connector (10) is disclosed. The connector (10) comprises a substantially annular ring (11) which has a lug (22) to which an electrical cable (23) is clamped. The connector (10) further comprises a pivotal member (13) which is manually graspable and which is used to move a clamping member (17) into engagement with one of a plurality or sockets (19) positioned on the exterior surface of the ring (11). The pivotal member (13) when pivoted towards the annular ring (11) with the clamping member engaged in one of the sockets (19) draws the two ends (12 and 20) together for the connector (10) to clamp onto a battery terminal.

17 Claims, 6 Drawing Sheets

BATTERY TERMINAL CONNECTOR

The present invention relates to battery terminals and, in particular, to a snap-lock battery terminal which is easy to remove and install.

Battery terminals for motor vehicle batteries and the like usually consist of a pair of half rings which are loose prior to installation. After the half rings have been fitted over the positive or negative terminal of the battery, a screw device is tightened for the terminal clamp to have a tight fit. This tight fit ensures that good electrical contact is made.

One disadvantage of this type of terminal clamp arrangement is that the removal and installation of the battery terminal usually requires a screw driver or a spanner. The use of such tools can be time consuming in the case of an electric vehicle such as a fork lift, where a bank of batteries are used to power the vehicle. It is also the case that it is often a requirement to disconnect or remove the battery terminal from the battery when the motor vehicles are being transported, such as by ship. The battery terminal should be disconnected or removed from the battery during such transportation to prevent an possibility that the battery will be dead once the motor vehicle is ready to be driven off the ship at its destination.

It is known to provide battery terminal clamps and French Patent No. 78 305 95 (Published under No. 2,440, 093); U.S. Pat. No. 1,30,772; and U.S. Pat. No. 1,943,190 exemplify the prior art.

However, in order to achieve a good clamping action it is necessary for the clamping ring to be relatively flexible and thus reasonably thin so that thick metal sections are not attempted to be deformed. Furthermore, in order to cater for different sizes of terminal posts, an adjustable clamping arrangement is required. Finally, in order to ensure a good electrical connection, the clamping action should surround the substantially cylindrical side wall of the terminal post.

OBJECT OF THE INVENTION

It is an object of the present invention to provide a snap-lock battery terminal which substantially overcomes or ameliorates the above mentioned disadvantages.

SUMMARY OF THE INVENTION

According to one aspect of the present invention there disclosed a snap-lock battery terminal comprising an annular ring of substantial longitudinal extent and minimal radial thickness which is longitudinally slit to form two ends, a lug protruding outwardly from the ring, said lug being used to attach an electric cable thereto, said annular ring having at one said end a manually graspable pivotal member pivotally connected thereto at a first location, said pivotal member having a clamping member pivotally connected thereto at a second location spaced from said first location, said annular ring further having at its other end at least two circumferentially spaced socket means with either of which said clamping member is able to engage, wherein said pivotal member when pivoted towards said annular ring with said clamping member engaged in one of said socket means simultaneously draws together the two ends of said annular ring and firstly increases, and then slightly decreases, the distance between said first and second locations.

BRIEF DESCRIPTION OF THE DRAWINGS

Some embodiments of the present invention will now be described with reference to the drawings in which.

BEST MODE OF CARRYING OUT THE INVENTION

Figure 1:
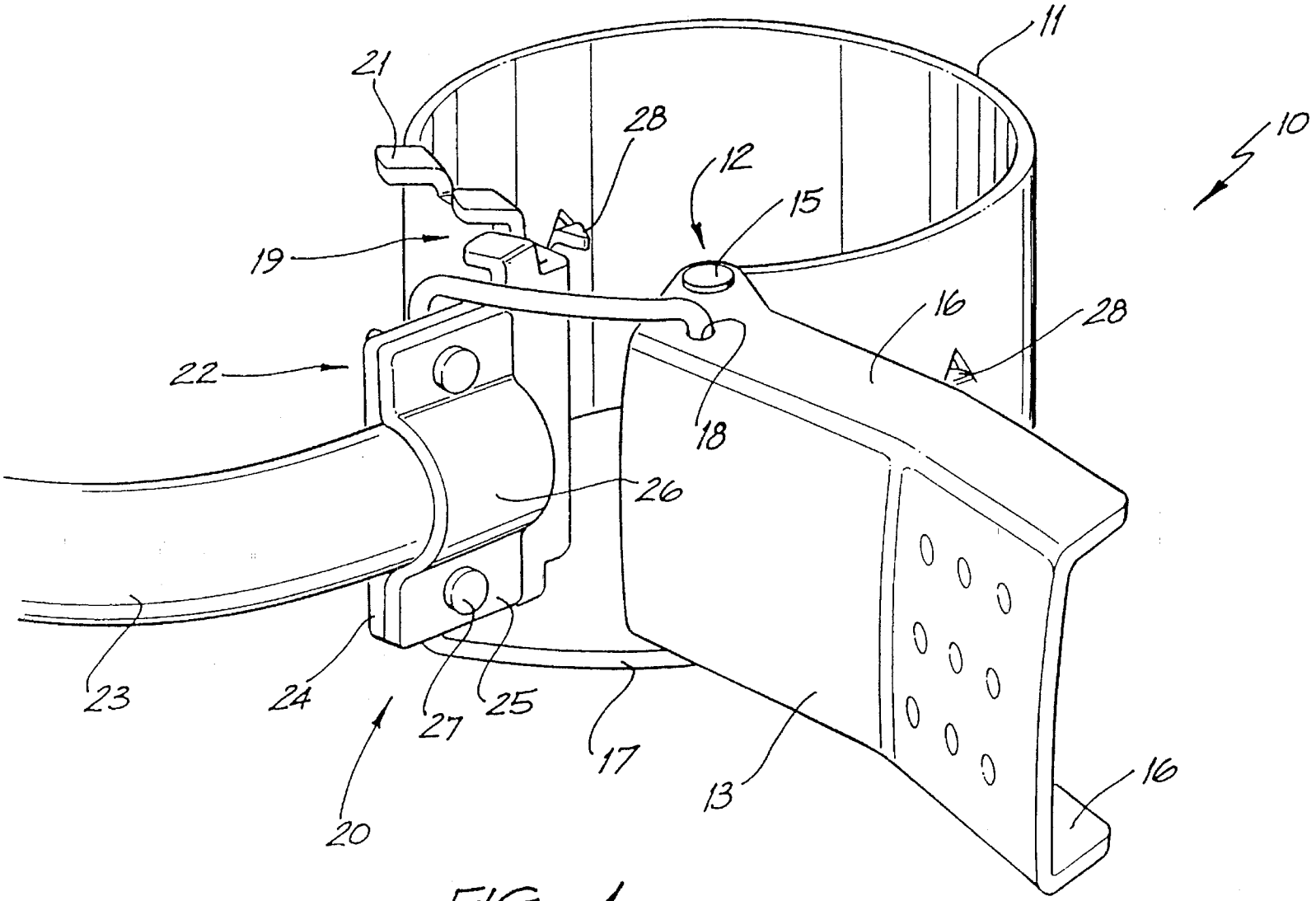
FIG. 1 is a perspective view of a terminal of a first embodiment shown in its open configuration.

A first embodiment of the snap-lock battery terminal 10 includes a partial ring 11. At one free end 12 of the ring 11, a pivotal member 13 is connected to a pair of lugs 14 located at the top and bottom thereof, by a pin 15 which passes through the pair of lugs 14. The pivotal member 13 includes a U-shaped channel the top and bottom sides 16 of which have the pin 15 passing therethrough and are located on the outside of the lugs 14. The pivotal member 13 has a clamping member 17 pivotally attached thereto. The clamping member 17 passes through holes 18 in the top and bottom sides 16 of the pivotal member 13. The clamping member 17 is substantially U-shaped length of were extending from the pivotal member and s able to be mated with two of a plurality of pairs of sockets 19 located at the other end 20 of the ring 11. Each socket 19 in this embodiment is formed by a lug 21 which has been bent outwardly from the ring 11. The clamping member 17 therefore engages with the sockets 19 when the clamping member 13 is pivoted into its clamped configuration as illustrated in FIG. 2.

The end 20 includes a lug 22 to which an electrical cable 23 is clamped. In this embodiment the lug 22 includes a flat section 24 against which another piece 25 having a trough 26 is secured together by a pair of barbed high tensile plastics pins 27. The pins 27 are easily inserted by hand and do not require the use of tools. The electrical cable 23 is clamped between the flat piece 24 and the trough 26.

The ring 11 has a pair of interior tangs 28 on opposite sides of the ring 11. The tangs 28 are used to provide grip and to prevent slippage around the battery posts (not illustrated) as the battery terminal 10 is clamped thereon. The tangs 28 also provide for greater electrical contact as the tangs 28 bite into the metal of the post.

Figure 2:
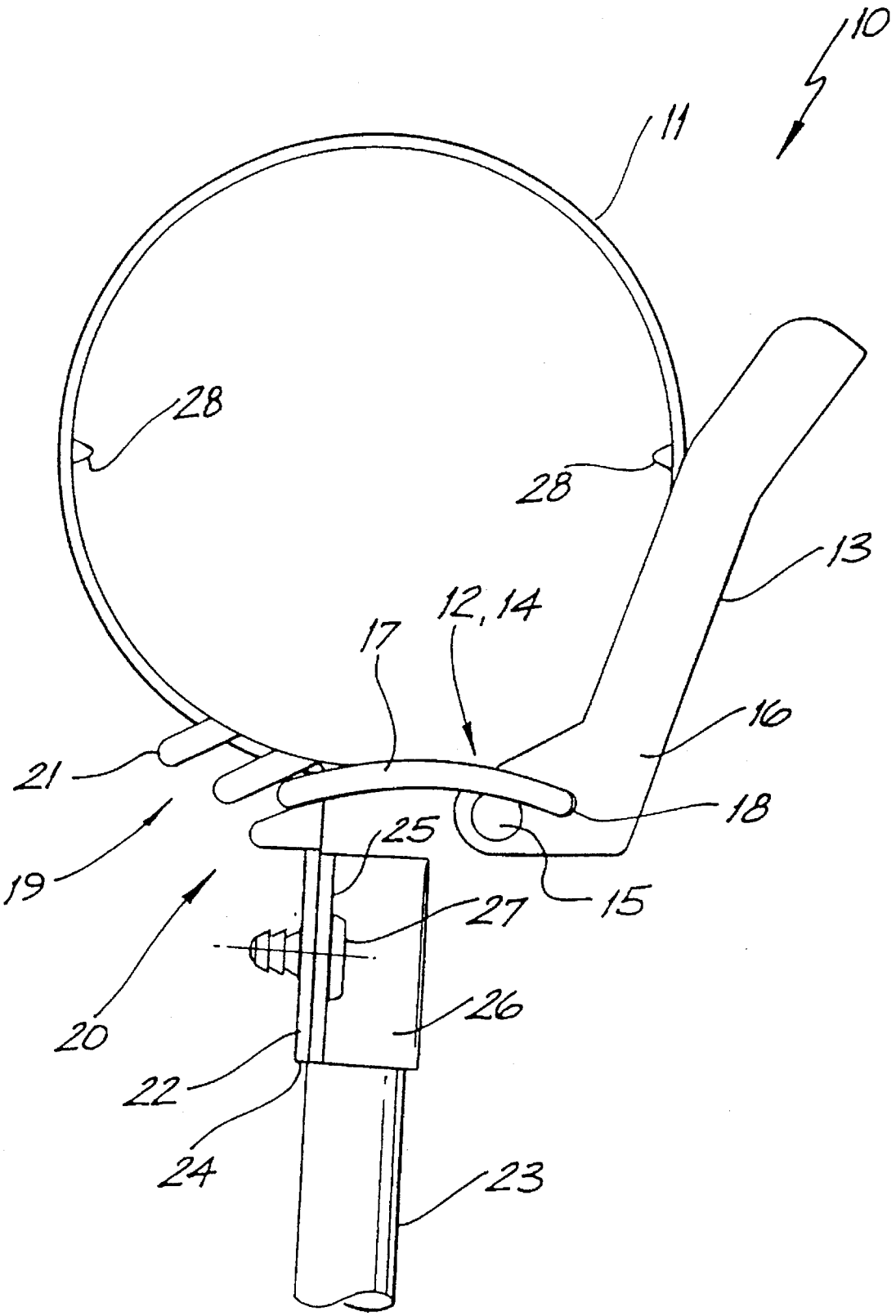
FIG. 2 is a plan view of the terminal of FIG. 1 shown in its closed configuration.

As illustrated in FIGS. 1 and 2, the clamping member 17 can be positioned in any of the sockets 19 depending on the relative dimensions of the ring 11 and the post. Once the clamping member 17 is in the correct position, the pivotal member 13 is thus pivoted which manipulates the clamping member 17 into an over-centre snap clamping arrangement thus drawing the free end 12 and the other end 20 together so that the ring 11 has a tight fit over the post. To remove the battery terminal 10, the pivotal member 13 is able to be moved by hand in the other direction thus loosening the ring 11 from the post. This allows the battery terminal 10 to be easily removed from the post as required.

If the fit between the terminal 10 and post is not tight enough for good electrical contact, the terminal 10 can be released and the clamping member 17 can be positioned in the next socket 19 moving away from the lug 22. This sequence can be continued until the desired tight fit is accomplished utilizing the provided sockets 19.

The ring 11 and the pivotal member 13 of the terminal 10 are preferably made from pressed metal and are bent into the desired shape. Alternatively, the pivotal member 13 can be made from moulded plastics and can be coloured red or black as required, ie, red for the connection to the positive battery post and black for the connection to the negative battery post.

Figure 3:
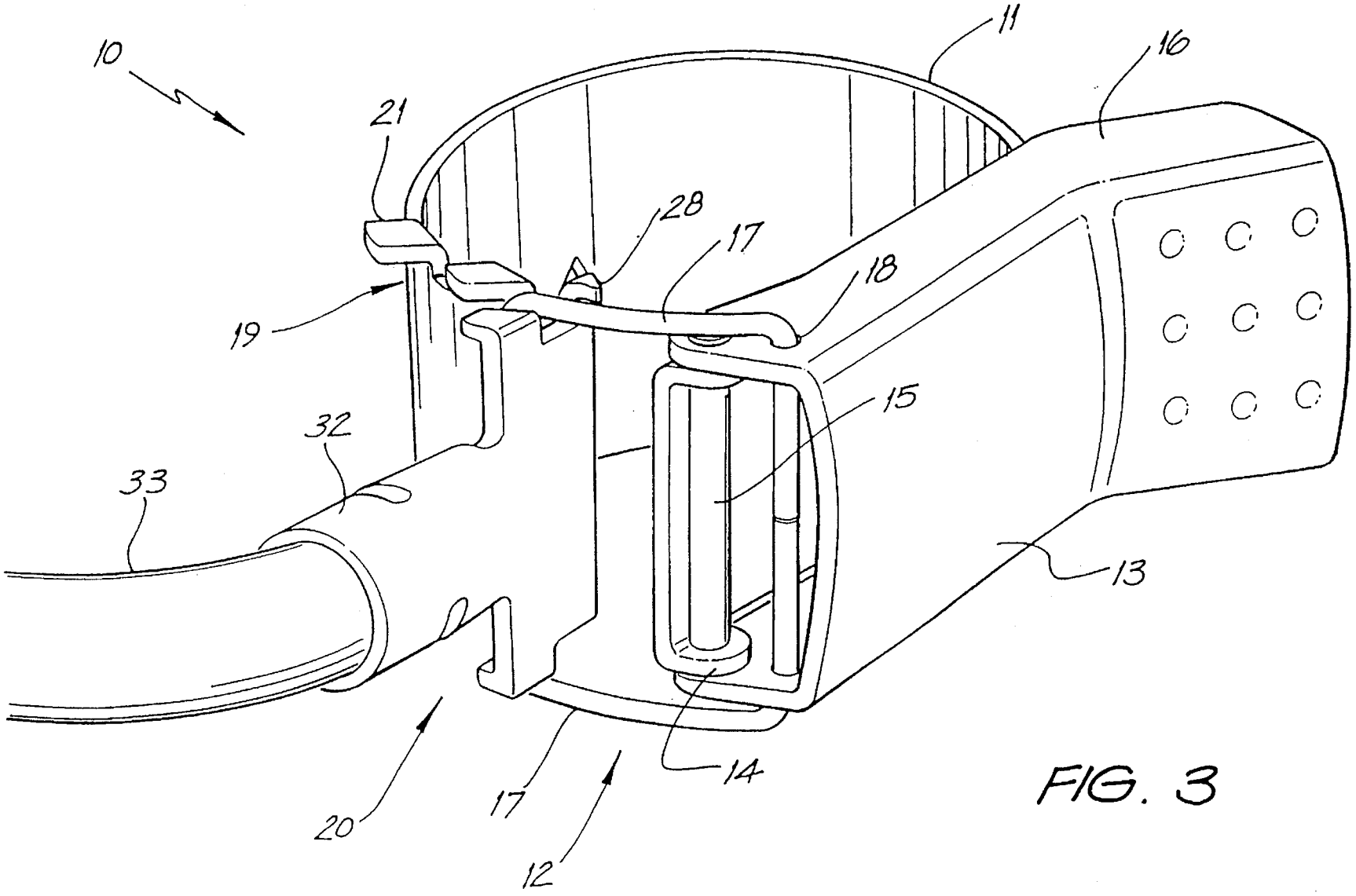
FIG. 3 is a perspective view of a terminal of a second embodiment shown in its open configuration.

A second embodiment is illustrated in FIG. 3. In this embodiment, the features are the same as the first embodiment except that an electrical cable 33 is crimped to a lug 32 located at the free end 20. This embodiment illustrates a different version of the connection of the electric cable 33 to the battery terminal 10.

Figure 4:
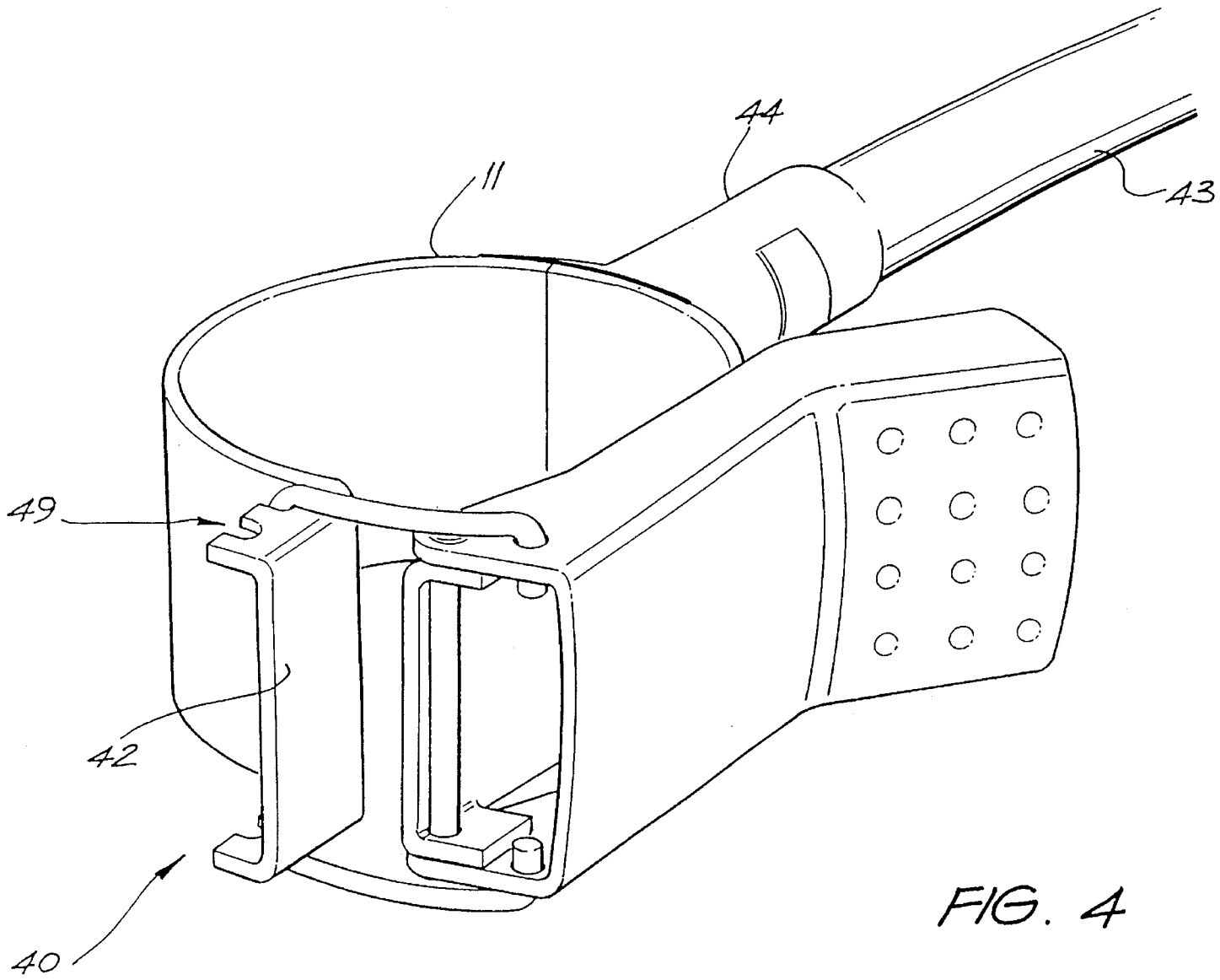
FIG. 4 is a perspective view of a terminal of a third embodiment.

A third embodiment is illustrated in FIG. 4. In this embodiment, a pair of sockets 49 are located at its other end 40. The end 40 has been bent radially relative to the ring 11 to form a radial lug 42. The sockets 49 are located in this bent lug 42. In this particular embodiment, an electric cable 43 is crimped into a lug 44 which is positioned on the ring 11 between its ends.

Figure 5:
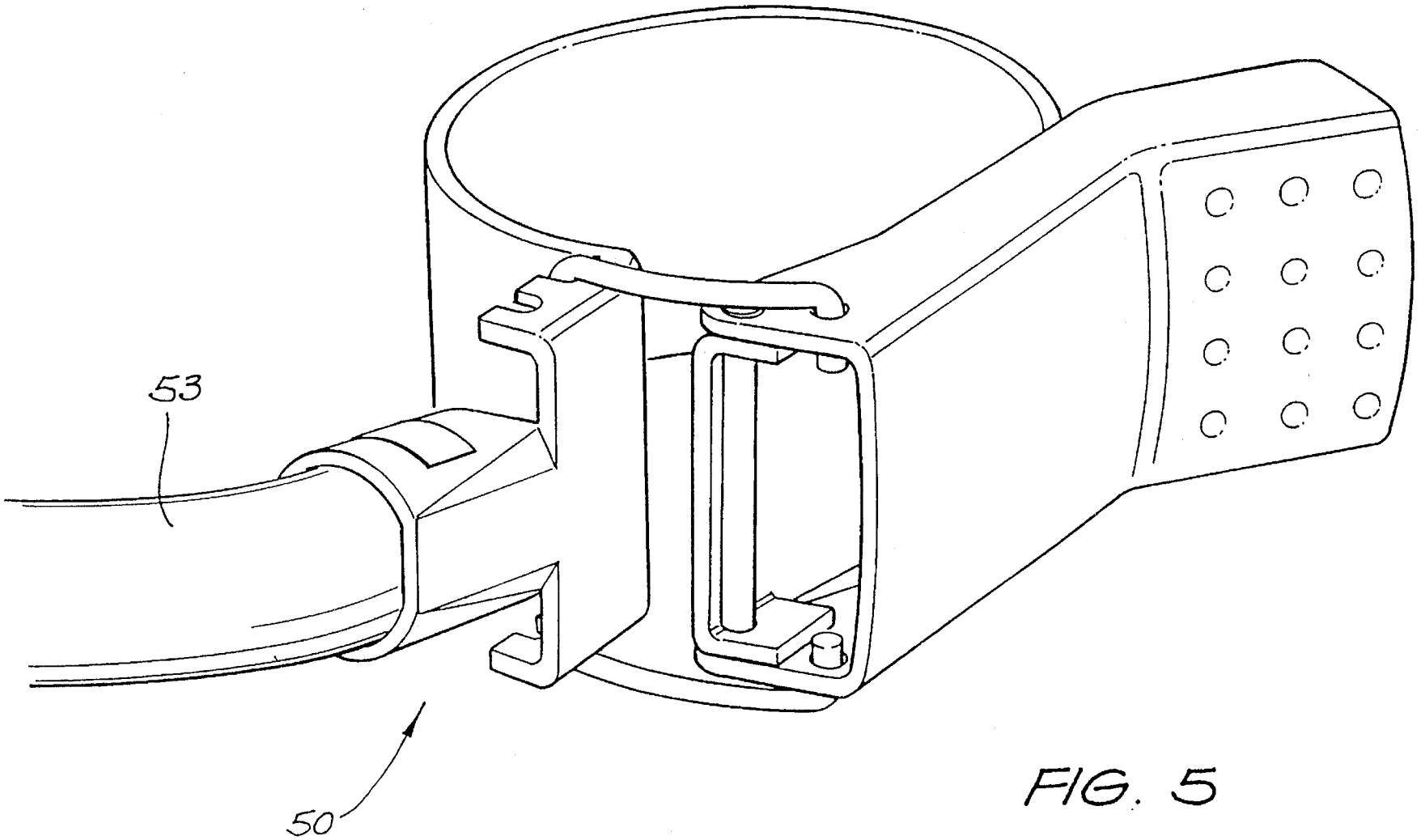
FIG. 5 is a perspective view of a terminal of a fourth embodiment.

In the embodiment illustrated in FIG. 5, the electrical cable 53 is attached to the free end 50 in a similar manner to the embodiment illustrated in FIG. 3.

Figure 6:
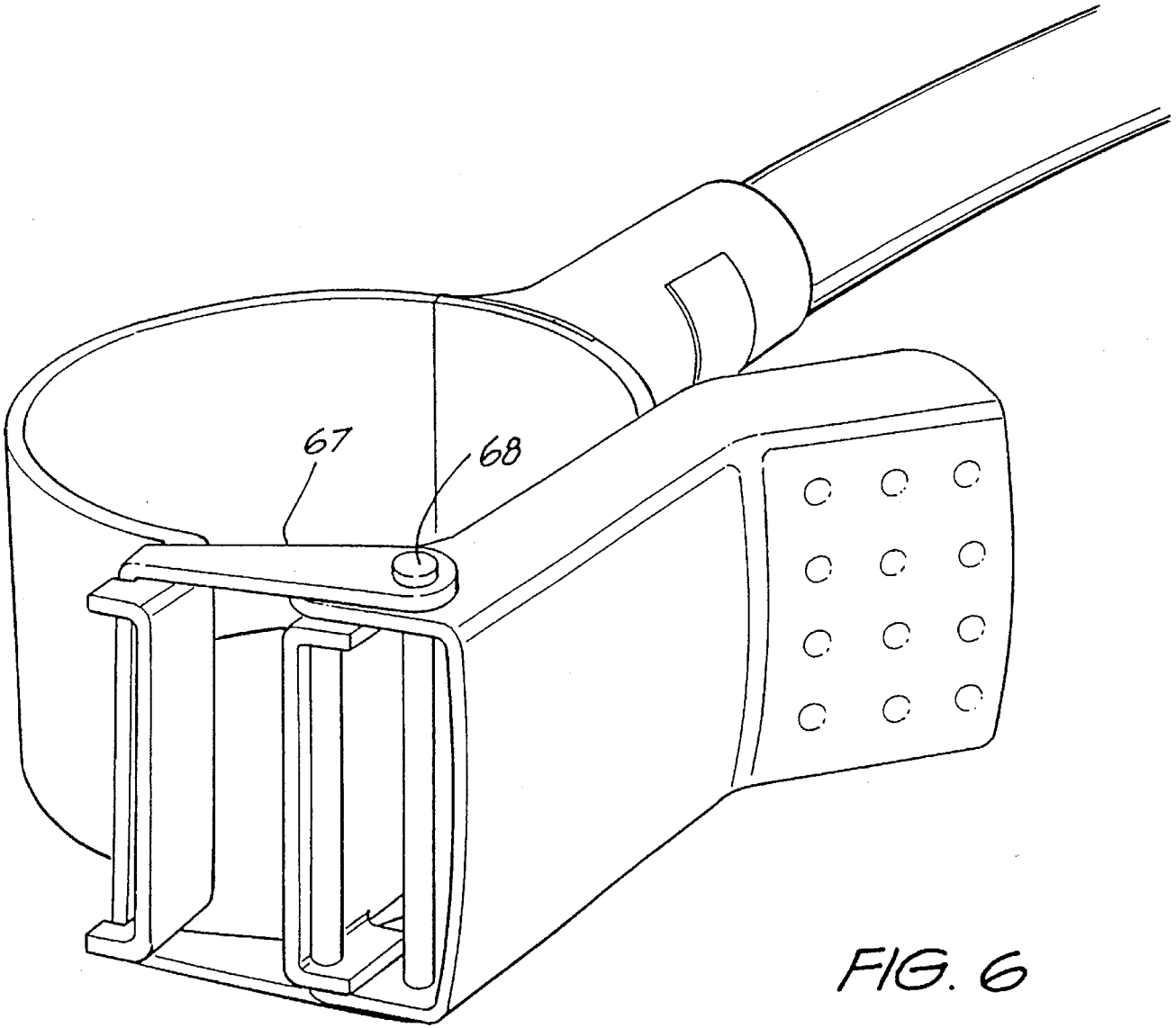
FIG. 6 is a perspective view of a terminal of a fifth embodiment.

In the embodiment of the invention illustrated in FIG. 6, a different style clamping member 67 is illustrated. The clamping member 67 is pivotally attached to a pin 68.

The foregoing describes only some embodiments of the present invention and modifications, obvious to those skilled in the art, can be made thereto without departing from the scope of the present invention.

We claim:

1. A snap-lock battery terminal comprising an annular ring of substantial longitudinal extent and minimal radial thickness which is longitudinally slit to form two ends, a lug protruding outwardly from the ring, said lug being used to attach an electric cable thereto, said annular ring having at one said end a manually graspable pivotal member pivotally connected thereto at a first location, said pivotal member having a clamping member pivotally connected thereto at a second location spaced from said first location, said annular ring further having its other end bent radially outward and including at least two spaced socket means with either of which said clamping member is able to engage, wherein said pivotal member when pivoted towards said annular ring with said clamping member engaged in one of said socket means simultaneously draws together the two ends of said annular ring and firstly increases, and then slightly decreases, the distance between said first and second locations.

2. A battery terminal according to any one of the preceding claims, wherein said lug which attaches said electrical cable is located at an end of said ring.

3. A battery terminal according to any one of claims 1 to 2, wherein said lug which attaches said electrical cable is located intermediate said ends.

4. A battery terminal according to claim 1, wherein said ring has at least one tang on its interior surface.

5. A battery terminal according to claim 1, wherein said pivotal member is made from plastics.

6. A battery terminal according to claim 1, wherein said lug which attaches said electrical cable includes two separate pieces which clamp said electrical cable therebetween, and at least one barbed pin is used to secure said two pieces together.

7. A battery terminal according to claim 1, wherein said clamping member is substantially U-shaped having arms extending from opposite sides of said pivotal member, and said socket means engages with the portion of said U-shaped member located between said arms.

8. A battery terminal according to claim 7, wherein said socket means comprises a pair of slots positioned adjacent longitudinally opposite edges of said ring at said other end and dimensioned to receive said clamping member.

9. A battery terminal according to claim 8, wherein one of said slot is formed between a pair of lugs which extend outwardly from said radially bent end of said ring.

10. A battery terminal according to claim 8, wherein said slots are formed in said radially outwardly bent end of said ring.

11. A snap-lock battery terminal comprising:

a discontinuous ring formed so as to have first and second ends spaced from one another;

a grasping member pivotally connected to said first end, said grasping member including a clamping member pivotally connected thereto so as to be pivotable towards said second end;

a receiving element provided at said second end including at least one pair of slots positioned adjacent longitudinally opposite edges of said second end of said ring constructed to detachable engage said clamping member; and a lug protruding outwardly from said ring, said lug including separate opposing plates and at least one securing pin operable to cooperate with said opposing plates so as to draw them together, said plates being constructed to capture and retain a cable member therebetween when secured to one another with said securing pin whereby an electrical connection is established.

12. A battery terminal according to claim 11, wherein said securing pin includes barbed side portions.

13. A battery terminal according to claim 11, wherein said pair of slots are formed between a pair of lugs which extend outwardly from said ring.

14. A battery terminal according to claim 11, when said slots are formed in proximity to said second end of said ring.

15. A battery terminal according to claim 11, wherein said ring includes at least one tang on its interior surface.

16. A battery terminal according to claim 11, wherein said second end including said receiving element is bent radially outward relative to said ring.

17. A battery terminal according to claim 16, wherein said receiving element includes a pair of slots in said radially bent end.

* * * * *